United States Patent [19]

Johst et al.

[11] Patent Number: 4,523,893

[45] Date of Patent: Jun. 18, 1985

[54] LIQUID RING PUMP

[76] Inventors: Willy Johst, Vingårdsgade 13, DK-9000 Aalborg; Henrik Elsass, Sophus Bauditzvej 13, DK-2920 Charlottenlund, both of Denmark

[21] Appl. No.: 535,026

[22] Filed: Sep. 23, 1983

[30] Foreign Application Priority Data

Dec. 9, 1982 [GB] United Kingdom ..... 8235149

[51] Int. Cl.[3] ..... F04C 19/00

[52] U.S. Cl. ..... 417/68

[58] Field of Search ..... 417/68, 69; 418/220

[56] References Cited

U.S. PATENT DOCUMENTS 1,310,584 7/1919 Smith ..... 417/68
1,831,336 11/1931 Abbott ..... 417/68
2,145,644 1/1939 Brace ..... 417/68

FOREIGN PATENT DOCUMENTS 1425997 2/1976 United Kingdom ..... 417/68

*Primary Examiner*—Edward K. Look
*Attorney, Agent, or Firm*—Sherman Levy

[57] ABSTRACT

A liquid ring pump including a helically bladed rotor 2 eccentrically mounted in an elongated pump casing 1 and including a hub 3, a suction inlet 18 and a discharge outlet 19 at respective ends of the pump casing 1. The open space between the bladings ends at the inlet are closed by a preferably circular plate 26 and access to the space between the buildings is given only through one or more openings 27 in the plate 26. This results in a minimizing of the power loss.

Paddles 28 could be attached to the plate 26 and there could be a plate 31 at the discharge end as well. Further the holes 27 could be arranged in the hub 3, and the end of the rotor at the inlet end could be located in a cavity 32 in the end wall 10.

16 Claims, 22 Drawing Figures

LIQUID RING PUMP

CROSS REFERENCE TO RELATED APPLICATIONS

Pumps of this type are described and shown in the specification and drawing to the British Pat. Nos. 1,425,997 and 1,547,976. When such pumps are working there are a number of power losses which arise from the turbulent internal flow of the liquid ring. It would be desirable if the movement of any given particle of liquid could be confined to a strictly circular pattern in relation to the outer pump casing and to a strictly radial pattern when related to the rotor. That would be the ideal manner of behavior of the liquid ring and while such behavior is never fully obtainable, the following principles of construction will contribute substantially towards the achievement of such conditions.

BACKGROUND OF THE INVENTION

The most dominant, disturbing turbulence is an axial circulation with a heavy turbulence around the tip of the blading at the end wall in the pumps suction side such as indicated by the arrows in FIG. 1. There are two major reasons for this flow, one is the bladings inherent tendency to act as a screw conveyor and the second is the pumps differential pressure, which tends to push the liquid back through the pump from the discharge side towards the suction side. When this flow of liquid meets with the stationary end plate, the friction between the end plate and liquid causes a reduction in the liquid particles velocity, which has a further increasing effect on the turbulence. This effect is most noticeable at the pumps suction side, but it occurs also to a lesser degree at the discharge side.

Further this type of pump is among other things typical in that an axially cross section through the rotor shows the blades (or worm turns) cross section being perpendicular to the axle.

This position of the blades which is commonly known from each and every screw conveyor is however the cause of a substantial loss of power when used in a pump of the types dealt with.

The best, i.e., the working condition results in a minimum loss of power for such a pump, is a condition where each and every particle in the liquid ring follows a complete circular pattern in a cross section perpendicular to the axle.

The eccentricity of the liquid ring with respect to the rotor result however is that there between the turn of the liquid particles and the work occurs a relative motion which breaks the liquid ring twice per revolution and which thereby results in a great loss of power.

SUMMARY OF THE INVENTION

It is an object of the present invention to improve the efficiency of such pumps by obviating or mitigating the above described power loss.

According to the invention the open space between the bladings end at the inlet are closed by a preferably circular plate and access to the space between the bladings is given only through one or more openings in the plate. The total area of these holes is calculated so that it gives a reasonable flow velocity of the air (or gasses) which the pump is supposed to handle.

A further embodiment of the invention has a number of paddles attached to this plate at the side facing towards the inlet so that in effect it becomes an open sided impeller. These paddles can have various shapes designed to the purpose of the pump.

At a further embodiment of the invention also the open space between the bladings ends at the outlet are closed by a preferably circular plate and access to the space between the bladings is given only through one or more openings in the plate.

In this case a number of paddles could also be attached to the plate at the side facing towards the outlet in the same manner as at the inlet.

Further the paddle at the discharge side is substantially shorter than the paddles at the suction side. The length of these paddles has preferably been reduced so much that their centrifugal effect on the liquid ring is just enough to maintain the liquid ring in shape when the pump is operating at zero differential pressure.

When both ends are closed with a plate as mentioned above, this gives the particular advantage that the total length of the blading can be reduced without loss of capacity.

As for the location and shape of the openings in the rotor ends plates it should be noted that they are placed as close to the rotors hub as possible and in rotors for pumps with small eccentricities they may be arranged in the hub. In rotors where the bladings are extended for more than one turn per start of blading, the holes are preferably evenly spaced, but on rotors where two sets (or starts) of bladings extends over only one full turn each, it is essential that the holes are located as close to the start and ending of the blading as possible. From a production point of view round holes are preferred but other shapes are equally acceptable.

Since pumps made to the principles of the above mentioned British Pat. Nos. 1,425,997 and 1,547,976 have been brought on the market there has been an increasing tendency to use them as combined water and vacuum pumps or superfast, self-priming centrifugal pumps. To increase the efficiency of such pumps the end plates is modified at the suction side. The rotor is essentially as described above with end plates and paddles, but this part of the rotor is located in a circular cavity in the end walls preferably in such manner that the rotor runs concentric with the cavity, thus permitting an undisturbed flow through the "impeller" part of the rotor. This "undisturbed" flow is made possible because the depth of the cavity is equal to the width of the paddles, so that the inner part of the impeller is shielded from the pulsations which the radial movement of the liquid ring would otherwise impose upon the flow through the impeller.

An even further development of the invention is characterized in that the edge of the helical blades of the rotor is pulled forward in the transportation direction compared with the base of the helical on the hub, a distance at least so the water particles in the liquid ring describe a circular pattern. Thus the water particles will not be affected by the blades and will describe the ideal circular pattern.

As the liquid ring in addition to the relative movement mentioned previously in consequence of the eccentricity also gets a relative movement to the rotor due to frictional loss in the pump, in general it can in practice be reasonable to compensate therefore by pulling the edge of the helical blades on the rotor even further forward than the eccentricity and the pitch of the worm conditions to avoid the disadvantageous effect the relative movement causes.

The helical blades on the rotor need not to be straight but can have a slight curved form.

An even further embodiment of the invention is characterized in that the pump comprises an impeller on the same shaft as the rotor and placed with the impeller blades in a short distance to the end wall of the rotor housing at the discharge end, thereby preventing or at least delaying a flow of water from the discharge end back into the rotor housing. The effect being increased when there in the end wall at the edge of the impeller is a circular cavity with radial walls spaced throughout the cavity. At a further improvement of the pump there is a sickle shaped plate attached to the rotor housing. Its purpose is to brake the axial flow mentioned above. Depending on its length a pump can have one or more of these plates.

At a special embodiment of the pump, holes are arranged in the top part of the end walls and the sickle shaped plates serve the purpose of breaking the siphoning effect when these pumps are used as water pumps without check valves. When the pumps are stopped this arrangement permits enough water to be left in the pump so that it can prime automatically when started again.

BRIEF DESCRIPTION OF THE DRAWINGS

Embodiments of the present invention will now be described by way of example with reference to the accompanying drawings in which.

DESCRIPTION OF PREFERRED EMBODIMENT

Figure 1:
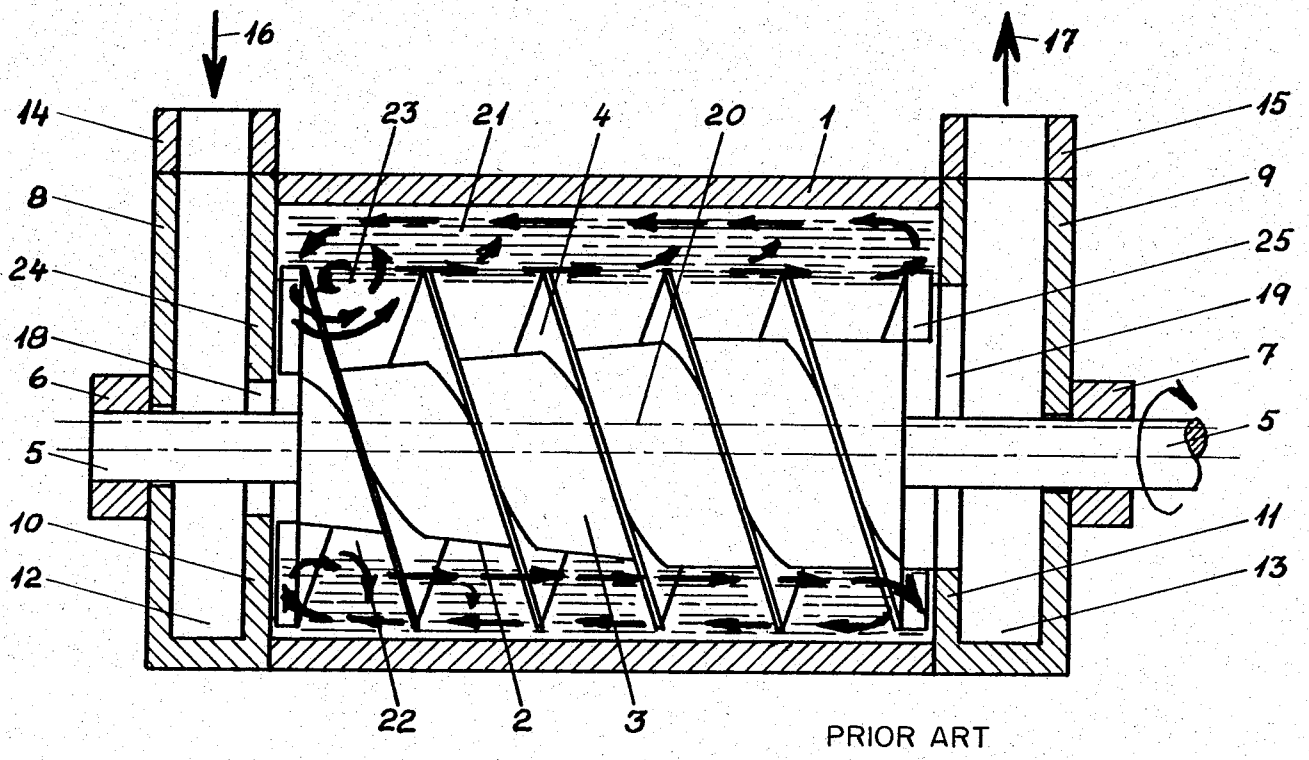
FIG. 1 shows a cross-sectional elevation view of a previously known ring pump.
Figure 3:
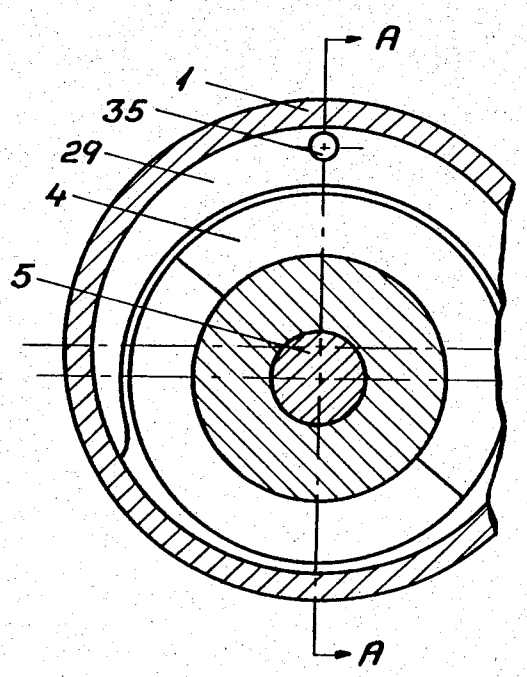
FIG. 3 shows an end view of the pump of FIG. 1 through the section B—B looking in the direction of the arrows.

Referring to FIG. 1, a previously known liquid ring pump includes a cylindrical pump casing 1 housing a rotor 2 comprising a rotor hub 3 carrying integral therewith continuous helical (worm) blading 4. The rotor 2 is fastened to a pump shaft 5 which is driven by suitable drive means and which is supported in bearings 6 and 7 located in the outer end walls 8 and 9. The walls 8 and 9 form with inner end walls 10 and 11 an inlet suction chamber 12 and a discharge chamber 13, respectively, on which are secured for example by welding a suction pipe branch 14 and a discharge pipe branch 15 respectively. The suction and discharge directions are indicated by arrows 16 and 17 respectively.

In the end walls 10 and 11 through openings 18 and 19 are provided for fluid connection of the suction and discharge chambers 12, 13, with the interior of the casing 1. The cylindrical pump casing 1 is sealingly attached to the end walls 10, 11, the center line of the casing 1 being shown by dot-and-dash line 20.

If the pump shown in FIG. 1 is working without back pressure and without suction resistance, a liquid ring 21 will be maintained in the casing 1, which liquid ring will theoretically be located mainly on the inside cylindrical surface of the casing 1 as indicated by lines 22 and 23 for example.

For reasons related to the flow its ends can be provided with driver means 24 and 25. For the pumps according to the present invention described in the following, the same reference numbers as above indicate the same parts.

As explained in the preamble, when such a pump is working there are a number of power losses which arise from the turbulent internal flow of the liquid ring.

The most dominant, disturbing turbulence is an axial circulation with a heavy turbulence around the tip of the blading at the end wall in the pumps suction side such as indicated by the arrows in FIG. 1.

Figure 6:
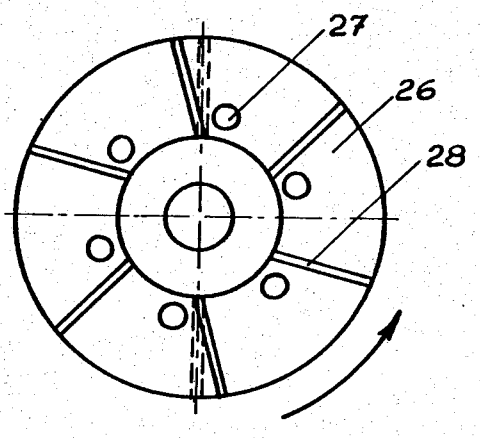
FIGS. 4, 5, 6 show end views of the rotor at the inlet end seen towards the discharge end and with different impellers.
Figure 5:
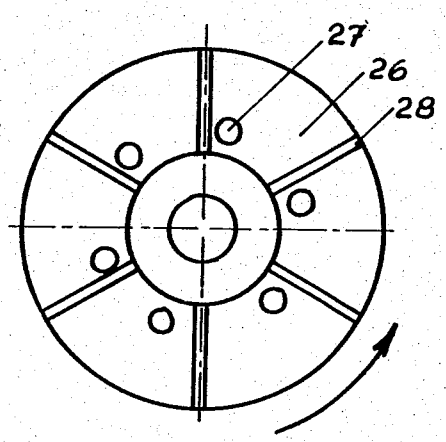
Figure 4:
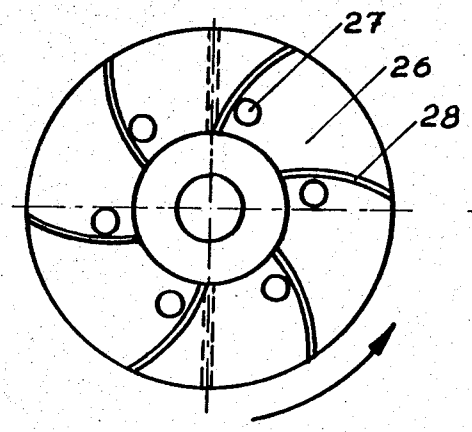

To improve the conditions there has been introduced the following particulars of design as they are shown on the FIGS. 2–21. Instead of leaving a nearly 180 degree open space between the bladings 4 ends, the access to the space between the blading 4 has been closed by means of a circular plate 26 which gives access to the space between the bladings only through a number of openings 27, shown on FIGS. 4, 5, 6 as holes in the plate 26. The total area of these holes is calculated so that it gives a reasonable flow velocity of the air (or gases) which the pump is supposed to handle. A number of paddles 28 are attached to this plate 26 so that in effect it becomes an open sided impeller. Various shapes of these paddles 28 are shown in FIGS. 4, 5, 6 where FIG. 4 is for a pump designed to pump mainly liquid, FIG. 5 is for a pump designed to pump mainly air (or gases) but mixed with some liquid, and FIG. 6 is for a pump to pump only air or gases.

Figure 2:
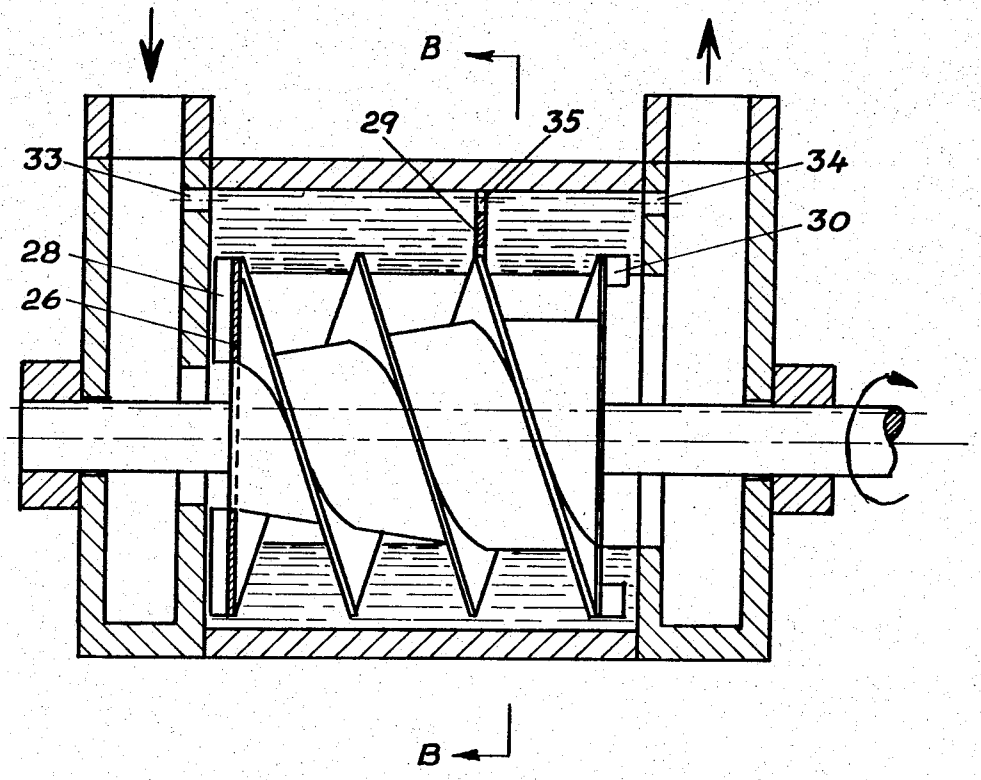
FIG. 2 shows a cross-sectional elevation view of a liquid ring pump according to one embodiment of the present invention through the section A—A in FIG. 3.

In FIG. 2 is a sickle shaped plate 29 attached to the rotor housing 1. Its purpose is to brake the axial flow mentioned above. Depending on its length a pump can have one or more of these plates 29.

Further on FIG. 2 there is indicated paddles 30 at the discharge side as being substantially shorter than the paddles 28 at the suction side. In comparison with the previously known pump of FIG. 1 the length of these paddles 30 have been reduced so much that their centrifugal effect on the liquid ring 21 is just enough to maintain the liquid ring in shape when the pump is operating at zero differential pressure.

Figure 8:
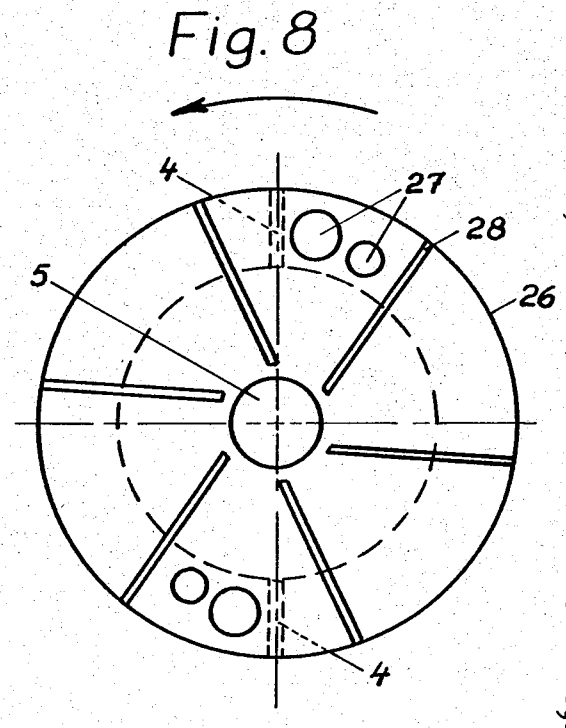
FIGS. 7, 8, 9 show an elevation view and end views respectively of another embodiment of the rotor.
Figure 7:
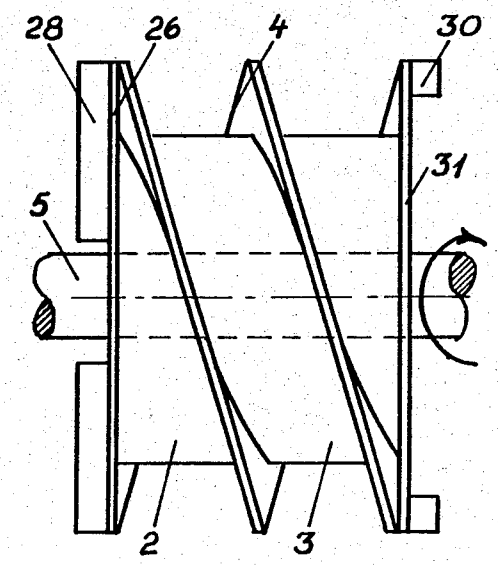
Figure 9:
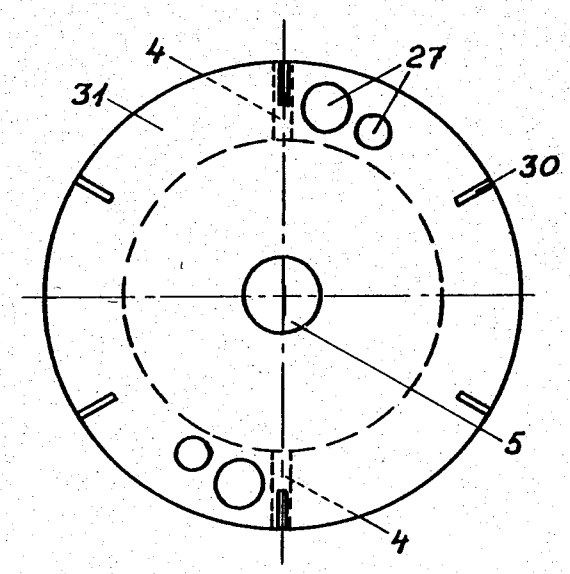

FIGS. 7, 8, 9 shows a rotor where both ends are closed with a plate 26, 31 as mentioned above, and this gives the particular advantage that the total length of the blading 4 can be reduced—here by approximately ⅓ as compared to the rotor in FIG. 2—without loss of capacity. Please note also here long paddles 28 on the suction side and short paddles 30 on the discharge side.

When a rotor as FIGS. 7, 8, 9 is fitted with the paddles 28, 30 it is possible to obtain very substantial savings in power consumptions of pumps for air or gases—but not so much for liquid pumps.

Figure 10:
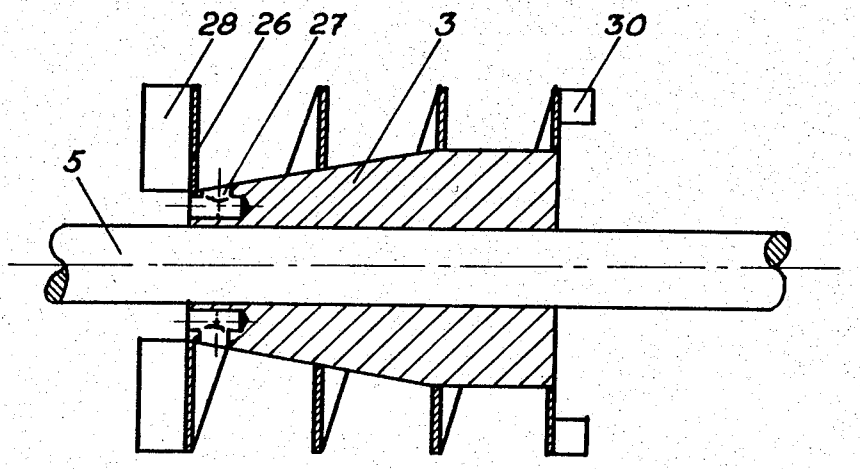
FIG. 10 shows a cross-sectional elevation view of a further embodiment of a rotor.
Figure 12:
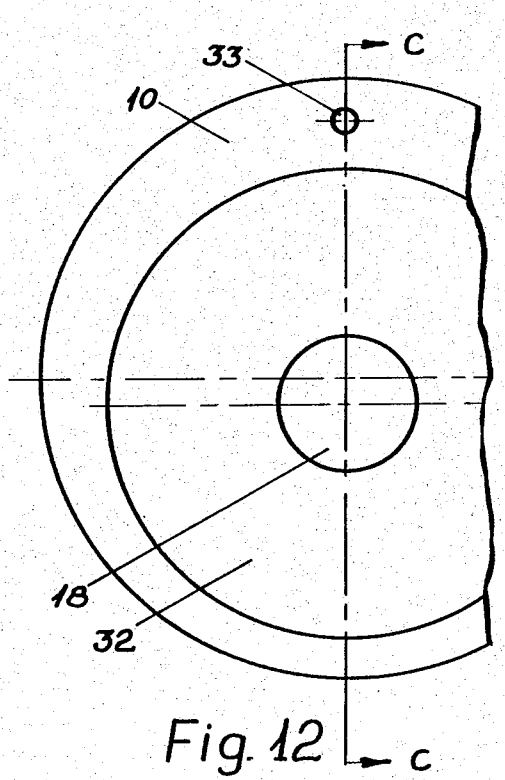
FIG. 12 shows an end view of the pump of FIG. 1 through the section B—B looking in the direction of the arrows, and with the rotor removed.

As for the location and shape of the holes 27 in the rotor end plates 26, 31 it should be noted that they are placed as close to the rotors hub 3 as possible and in rotors for pumps with small eccentricities they may be arranged in the hub 3 as shown in FIG. 10. In rotors where the bladings are extended for more than one turn per start of blading, the holes 27 are preferably evenly spaced, as in FIGS. 4, 5, 6, but on rotors as shown in FIGS. 7, 8, 9 where two sets (or starts) of bladings extend over only one full turn each it is essential that the holes 27 are located as close to the start and ending of the blading 4 as possible. From a production point of view round holes are preferred, but other shapes are equally acceptable.

Figure 11:
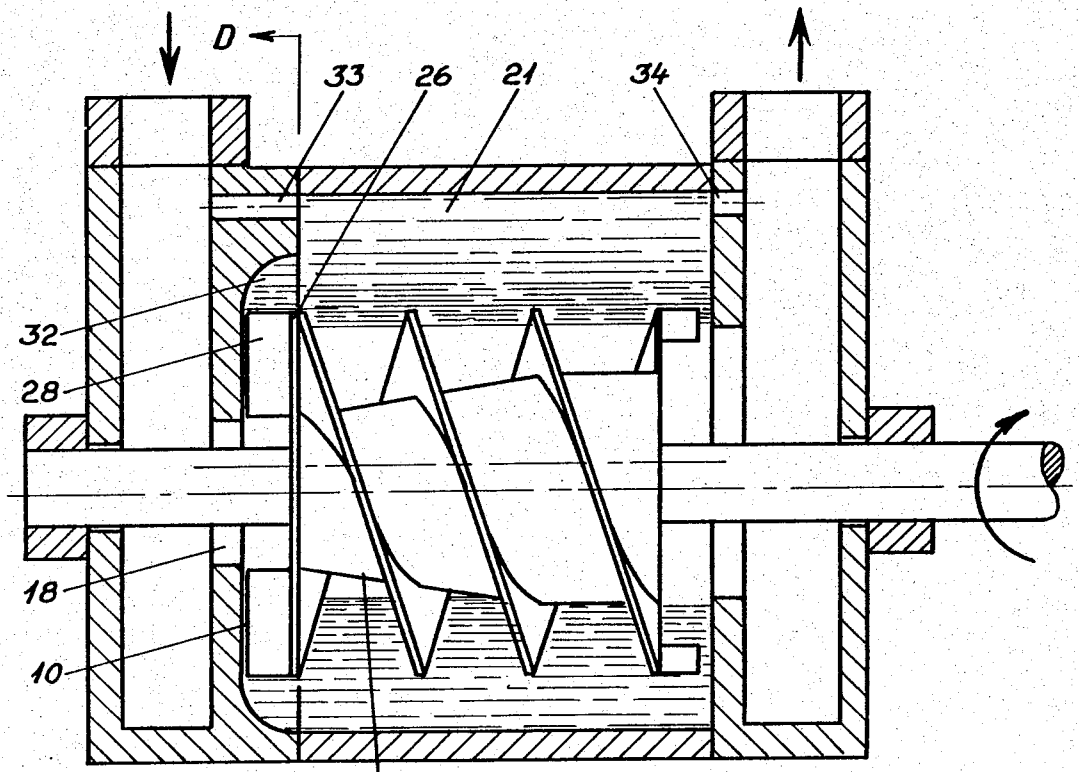
FIG. 11 shows a cross-sectional elevation view of a liquid ring pump according to another embodiment of the present invention through the section C—C in FIG. 12.

Since pumps made to the principles of Pat. Nos. 1,425,997 and 1,547,976 have been brought on the market there has been an increasing tendency to use them as combined water and vacuum pumps or superfast self-priming centrifugal pumps. To increase the efficiency of such pumps, the end plate has been modified at the suction side as shown in FIG. 11. The rotor 2 is essentially like the rotor 2 in the pump in FIG. 2 with end plate 26 and paddles 28 as in FIG. 4, but this part of the rotor is located in a circular cavity 32 in the inner end wall 10 in such a manner that the rotor 2 runs concentric with the cavity 32, thus permitting an undisturbed flow through the "impeller" 28 part of the rotor. This "undisturbed" flow is made possible because the depth of the cavity 32 is equal to the width of the paddles 28, so that the inner part of the impeller is shielded from the pulsations which the radial movement of the liquid ring 21 would otherwise impose upon the flow through the impeller.

The holes 33, 34, 35 in the inner walls 10, 11 and the sickle shaped plate 29 serve the purpose of breaking the siphoning effect when these pumps are used as water pumps without check valves. When the pumps are stopped this arrangement permits enough water to be left in the pump so that it can prime automatically when started again.

As discussed in the preamble the best, i.e., the working condition which results in a minimum loss of power, is a condition where the particles in the liquid ring follow a complete circular pattern in a cross section perpendicular to the axle.

Figure 13:
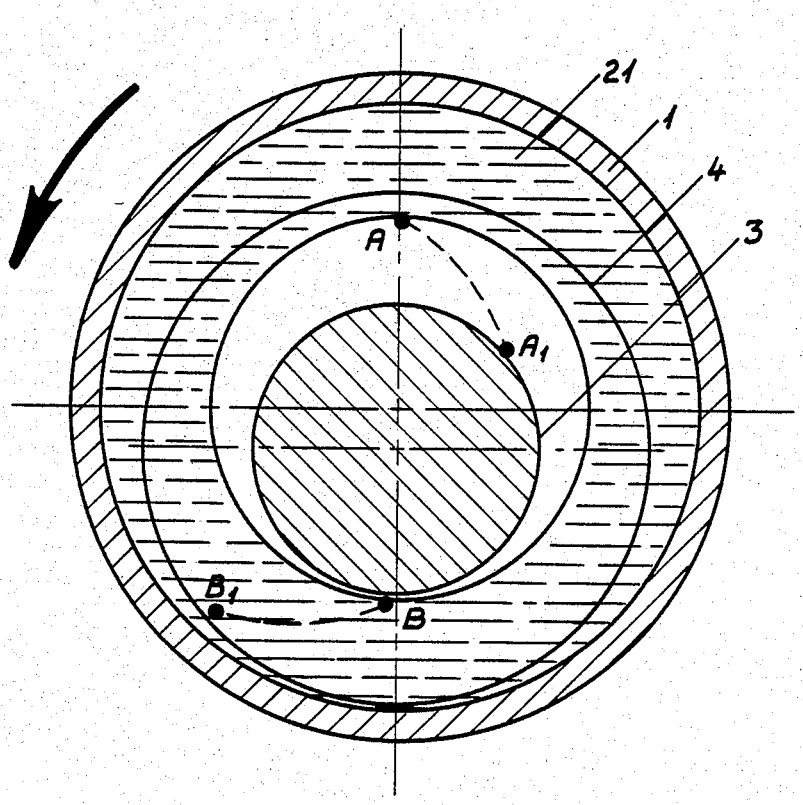
FIG. 13 shows an end view of a previously known pump.

The end view of a previously known liquid ring pump of FIG. 13 illustrates the relative movement between the liquid particles and the blades on the worm. The figure shows the pattern which a liquid particle A runs through relative to the blades on the worm before it meets the hub 3 in the point $A_1$. Analogous a particle B is during the run through of its pattern towards $B_1$ given an axial movement of the same size and oriented in the same direction.

These relative movements thus cause a tendency to a liquid movement in the transporting direction of the worm. As such a transport nevertheless is impossible because of the end wall 11 of the pump casing the tendency releases an overflow of the bladings 4 on worm 2, which on its side causes a violent turbulence resulting in a great loss of power.

Figure 14:
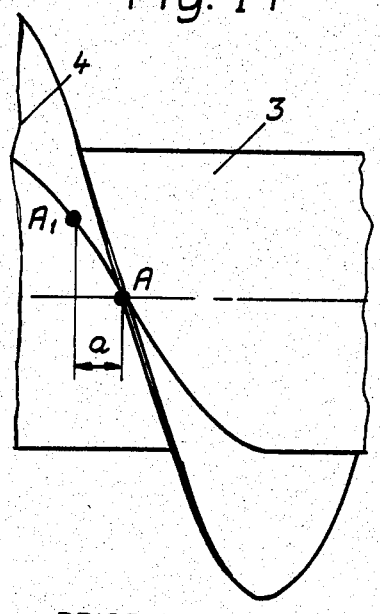
FIGS. 14, 16 show a cross-sectional elevation view of a rotor in a previously known pump.
Figure 15:
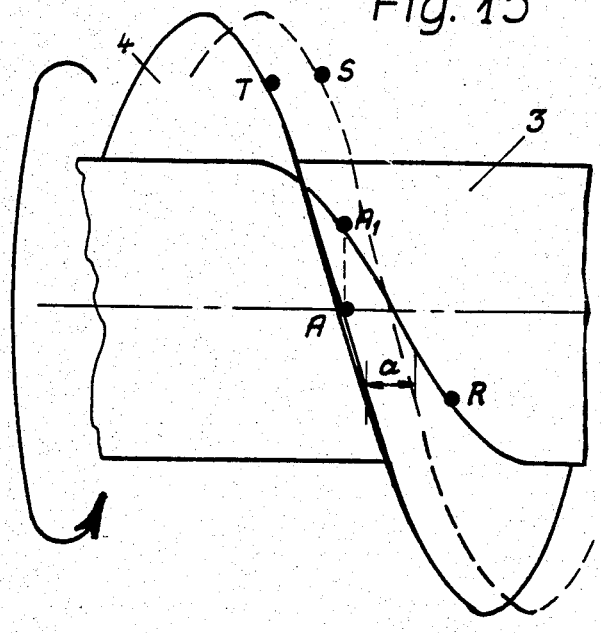
PRIOR ART Fig. 15
FIGS. 15, 17 show a cross-sectional elevation view of a rotor to a liquid ring pump according to one embodiment of the present invention.
Figure 16:
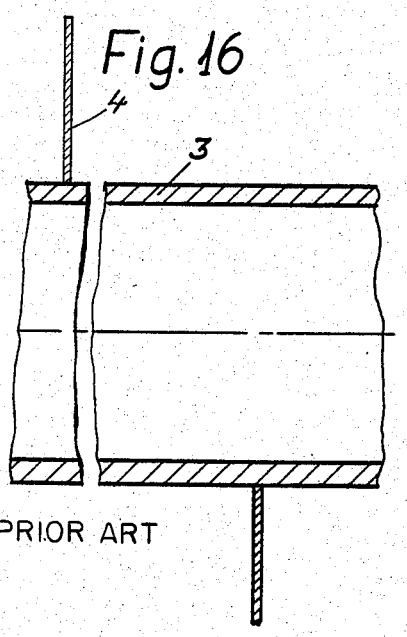
Figure 17:
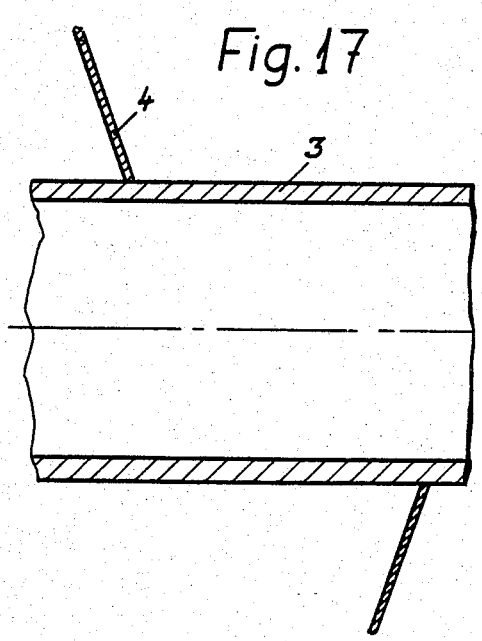
PRIOR ART Fig. 17

In FIG. 15 is shown a worm where the outer edge of the blade 4 is pulled forward in the transportation direction compared with the base of the helical on the hub 3 in such a manner that a cross-sectional view in FIG. 17 shows the blade 4 forming an angle with the rotor axle. In FIG. 15 is R the usual base, and S the usual position of the outer edge of the helical, while T indicates the edge in the position pulled forward. The axial movement from S to T corresponds to the distance A in FIG. 14 showing a known helical. As it appears in FIG. 15 the particle A will not be influenced by the helical blades during the run through of its pattern to point $A_1$, and correspondingly it will neither be influenced by the blades during the movement from B to $B_1$. Thus, the particles will describe the ideal circular pattern with minimum loss of power.

Figure 19:
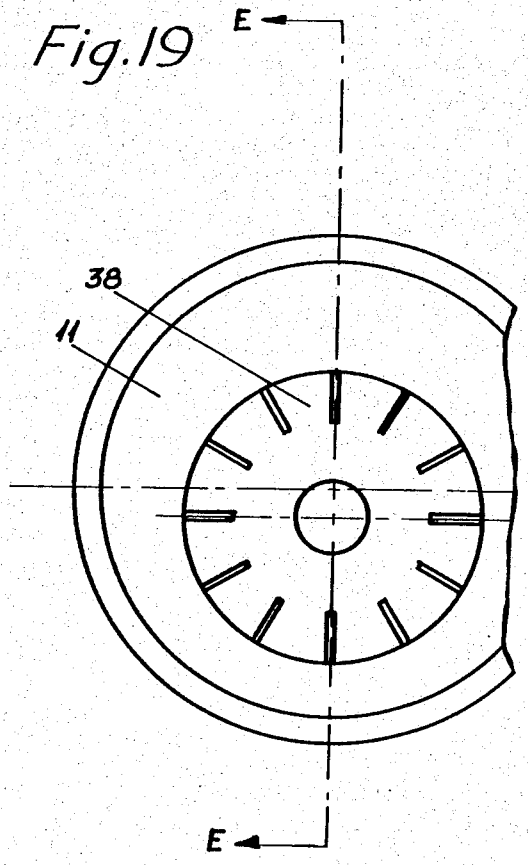
FIG. 19 shows an end view of the pump of FIG. 18 through the section F—F looking in the direction of the arrows.
Figure 18:
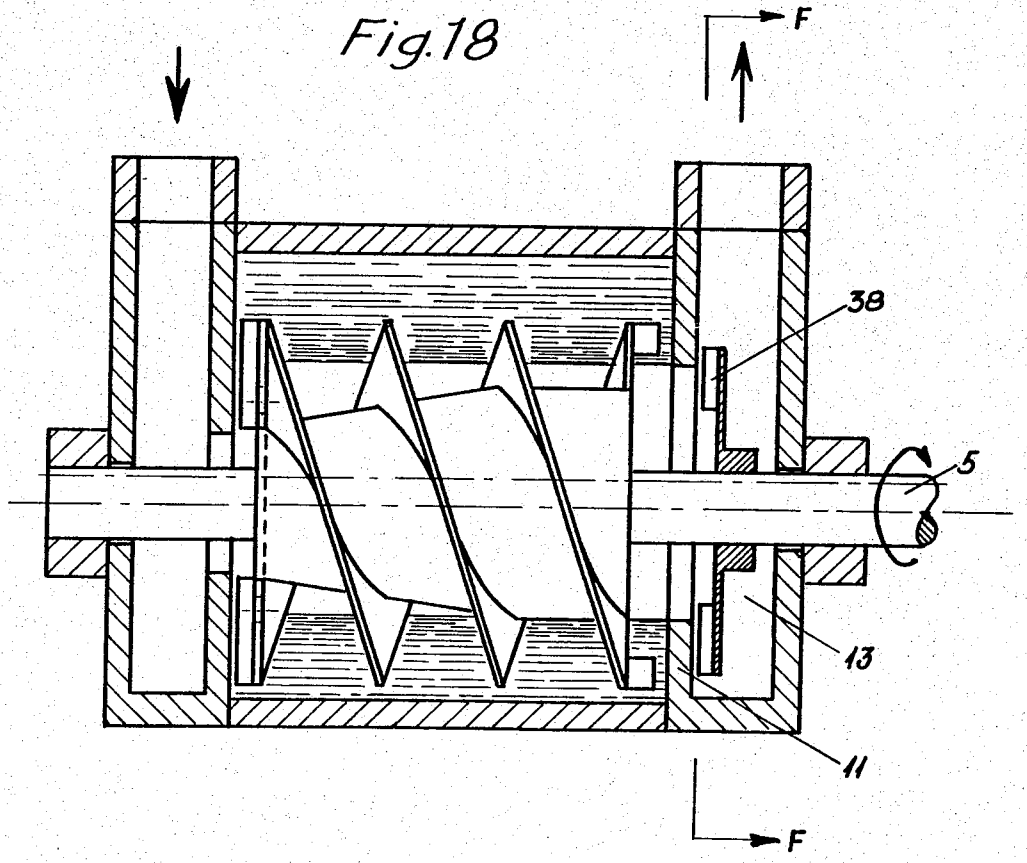
FIG. 18 shows a cross-sectional elevation view of a liquid ring pump according to another embodiment of the present invention through the section E—E in FIG. 19.
Figure 20A:
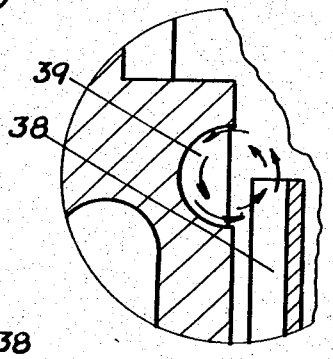
FIG. 20*a* is an enlarged view of the impeller and cavity shown in FIG. 20.
Figure 20:
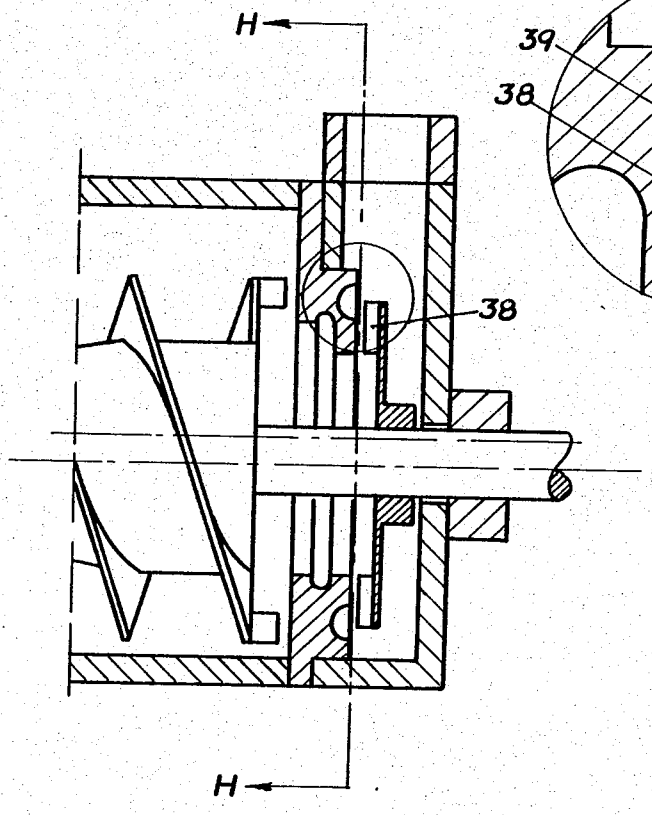
FIG. 20 shows a cross-sectional elevation view of the discharge end of a liquid ring pump according to a further embodiment of the present invention through the section G—G in FIG. 21.
Figure 21:
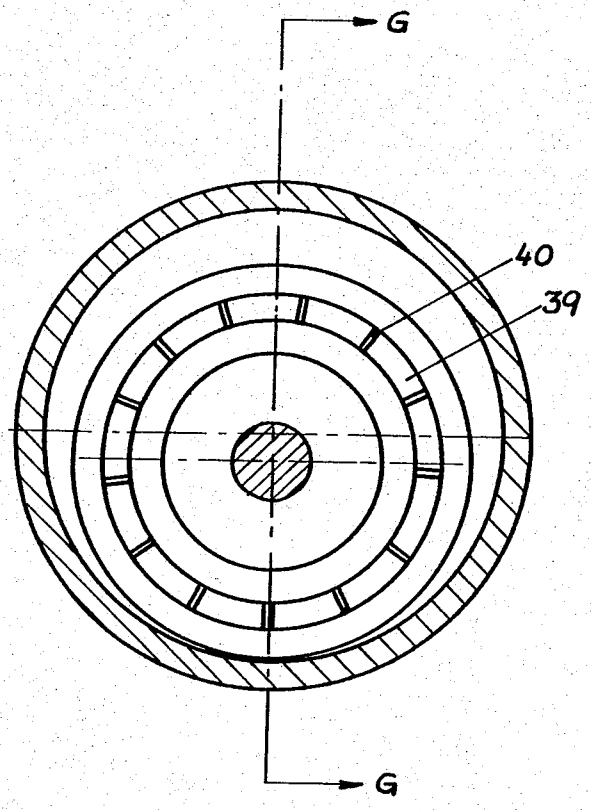
FIG. 21 shows an end view of the pump of FIG. 20 through the section H—H looking in the direction of the arrows.

In FIGS. 18 and 19 is shown a further embodiment of the liquid ring pump according to the present invention with an impeller 36 mounted on the shaft 4 and placed in the discharge chamber 13 in a short distance to the inner wall 11. This impeller 36 smoothing in some extent pulsation of the liquid flow as it prevents liquid to run backwards or at least delay the flow.

To obtain the higher degree of efficiency of this feature according to the invention, there is a ring formed cavity or groove 39 at the edge of the impeller 38 and with radial walls 40 spaced throughout the cavity. As indicated with the arrows in the enlarged picture in FIG. 20, there will be created a circular flow at the edge of the impeller 38 as the liquid running backwards will be caught in the cavity 39 and by the blades 38 be led perpendicular out in the impeller 38 again.

The invention has resulted in an improvement of a liquid ring pump with a minimum of power loss according for a certain capacity the power consumption is reduced radically or contrary with a certain power consumption the capacity is increased significantly.

We claim:

1. A liquid ring pump including a helically bladed rotor (2) eccentrically mounted in an elongated pump casing (1) and including a hub (3) for supporting the rotor, a suction inlet (18) and a discharge outlet (19) positioned at respective ends of the pump casing (1), characterized by a preferably circular plate (26) being fixedly mounted on the hub proximate that one of the respective ends of pump casing at the inlet and for closing the open space between the bladings ends at the inlet, and access to the space between the bladings is given only through one or more openings (27) in the plate (26).

2. A liquid ring pump as claimed in claim 1, characterized in that a plurality of paddles (28) is attached to the plate (26) at the side facing towards the inlet (18).

3. A liquid ring pump as claimed in claim 2, characterized in that the paddles (30) at the outlet (19) are substantially shorter than the paddles (28) at the inlet (18).

4. A liquid ring pump as claimed in claim 1, characterized in that the open space between the bladings ends at the outlet (19) also is closed by a plate, said plate being preferably circular (31), and access to the space between the bladings is given only through one or more openings (27) in the plate (31).

5. A liquid ring pump as claimed in claim 4, characterized in that a plurality of paddles (30) is attached to the plate (31) at the side facing towards the outlet (19).

6. A liquid ring pump as claimed in claim 1, characterized in that the openings (28) are placed as close to the rotor hub (3) as possible.

7. A liquid ring pump as claimed in claim 6, characterized in that the said openings (27) are arranged in the hub (3).

8. A liquid ring pump as claimed in claim 1 or 2, characterized in that the end of the rotor at the inlet (18) bearing the plate (26) and the paddles (28) is located in a cavity (32) in the end wall (10) of the rotor housing (1) at the inlet.

9. A liquid ring pump as claimed in claim 8, characterized in that the rotor (2) runs concentric with said cavity (32).

10. A liquid ring pump as claimed in claim 1, characterized in that the edge of the helical blades (4) on the rotor (2) is pulled forward in the transportation direction compared with the base of the helical on the hub (3), a distance (a) at least such that the water particles in the liquid ring describe a circular pattern.

11. A liquid ring pump as claimed in claim 10, characterized in that the edge of the helical blades on the rotor (3) is pulled even further forward to compensate for the loss of friction in said liquid ring pump.

12. A liquid ring pump as defined in claim 10, characterized in that the helical blades (4) on the rotor (3) have a slight curved form.

13. A liquid ring pump as claimed in claim 1, characterized in that the pump comprises an impeller (38) on the same shaft (5) as the rotor (2) and placed with the impeller blades in a short distance to the end wall (11) of the rotor housing (1) at the outlet end (19).

14. A liquid ring pump as claimed in claim 13, characterized in that there is provided in the end wall (11) at the edge for the impeller (38) a circular cavity (39) with radial walls (40) spaced throughout the cavity.

15. A liquid ring pump as claimed in claim 1, characterized in that the pump comprises one or more sickle shaped plates (29) attached to the internal wall of the pump casing (1) and surrounding the rotor (2).

16. A liquid ring pump as claimed in claim 15, characterized in that there are one or more holes (35, 36, 37) arranged in the top part of the end walls (10, 11) of the rotor housing (1) and the sickle shaped plates (29).

* * * * *